US008357009B2

(12) United States Patent
Vrenna et al.

(10) Patent No.: US 8,357,009 B2
(45) Date of Patent: Jan. 22, 2013

(54) RECEPTACLE CONNECTOR FOR MOUNTING ON A PRINTED CIRCUIT

(75) Inventors: Jason Edward Vrenna, Angola, NY (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 97 days.

(21) Appl. No.: 12/855,008

(22) Filed: Aug. 12, 2010

(65) Prior Publication Data

US 2012/0040538 A1 Feb. 16, 2012

(51) Int. Cl.
*H01R 13/60* (2006.01)

(52) U.S. Cl. ..... 439/541.5

(58) Field of Classification Search ..... 439/541.5
See application file for complete search history.

(56) References Cited

U.S. PATENT DOCUMENTS 4,687,267 A * 8/1987 Header et al. ..... 439/62
5,316,489 A * 5/1994 Kachlic et al. ..... 439/79
5,782,644 A * 7/1998 Kiat ..... 439/79
6,293,818 B1 * 9/2001 Kim et al. ..... 439/495
6,413,120 B1 7/2002 Winings et al.
6,692,273 B1 2/2004 Korsunsky et al.
6,752,662 B2 * 6/2004 Okamoto ..... 439/607.04
7,018,237 B2 * 3/2006 Zhan et al. ..... 439/607.55
7,077,668 B2 * 7/2006 Lapidot et al. ..... 439/108
7,270,570 B1 9/2007 Hamner et al.
7,445,469 B2 * 11/2008 Wu ..... 439/79
7,665,998 B2 * 2/2010 Kressner et al. ..... 439/63
7,828,574 B2 * 11/2010 Zhu ..... 439/328

* cited by examiner

*Primary Examiner* — Truc Nguyen

(57) ABSTRACT

A receptacle connector is provided for mounting on a printed circuit having opposite sides and an edge surface intersecting the sides. The connector includes a shell having a mount configured to be mounted on at least one of the sides of the printed circuit. The shell includes a receptacle for receiving a mating connector therein. A housing extends at least partially within the receptacle of the shell. An electrical contact is held by the housing. The electrical contact includes a mounting segment configured to be mounted on the printed circuit. The electrical contact includes a transition segment that extends outwardly from the mounting segment and projects beyond the edge surface of the printed circuit when the electrical contact is mounted on the printed circuit. The electrical contact includes a mating segment that extends outwardly from the transition segment and within the receptacle of the shell. The mating segment includes a mating surface that extends a length that is aligned with a plane that intersects the edge surface of the printed circuit when the electrical contact is mounted on the printed circuit.

21 Claims, 6 Drawing Sheets

RECEPTACLE CONNECTOR FOR MOUNTING ON A PRINTED CIRCUIT

BACKGROUND OF THE INVENTION

The subject matter described and/or illustrated herein relates generally to receptacle connectors, and more particularly, to receptacle connectors that are mounted on printed circuits.

Electrical connectors that communicate multimedia signals can include connectors such as High-Definition Multimedia Interface ("HDMI") connectors. HDMI connectors communicate data, especially multimedia data such as audiovisual signals, for example. Some HDMI connectors include receptacles that receive the plug of another HDMI connector therein. HDMI plug connectors sometimes terminate HDMI cables, but may alternatively be incorporated into a docking station or other electronic device. HDMI receptacle connectors are often mounted along an interface of an electronic device. The HDMI receptacle connectors may be included in a variety of electronic devices such as computers, digital video recorders, set top boxes, and televisions, for example.

Existing HDMI receptacle connectors are mounted on printed circuits (sometimes referred to as "circuit boards") having one or more sides that include circuit elements thereon, such as electrical contacts, electrical traces, electrical vias, and/or the like. The receptacle connectors include shells that define the receptacle of the connector into which the plug of the HDMI connector is inserted. The receptacle connectors are mounted on the printed circuit such that the length of the shell, and thus the length of the receptacle, extends over and along a side of the printed circuit having circuit elements thereon. But, mounting the shells over and along a side of the printed circuit is an inefficient use of the limited space of the interface of the electronic device. For example, the shells of the receptacle connectors occupy space over the side of the printed circuit, which increases an overall size of the receptacle connector and the printed circuit. The increased size of the receptacle connector and the printed circuit is an inefficient use of the limited space of the interface of the electronic device that may limit the overall number of connectors that can be located along the interface, for example. Moreover, some of the connectors located along the interface may need to be staggered relative to each other to accommodate the desired number of connectors, which may be aesthetically displeasing.

BRIEF DESCRIPTION OF THE INVENTION

In one embodiment, a receptacle connector is provided for mounting on a printed circuit having opposite sides and an edge surface intersecting the sides. The connector includes a shell having a mount configured to be mounted on at least one of the sides of the printed circuit. The shell includes a receptacle for receiving a mating connector therein. A housing extends at least partially within the receptacle of the shell. An electrical contact is held by the housing. The electrical contact includes a mounting segment configured to be mounted on the printed circuit. The electrical contact includes a transition segment that extends outwardly from the mounting segment and projects beyond the edge surface of the printed circuit when the electrical contact is mounted on the printed circuit. The electrical contact includes a mating segment that extends outwardly from the transition segment and within the receptacle of the shell. The mating segment includes a mating surface that extends a length that is aligned with a plane that intersects the edge surface of the printed circuit when the electrical contact is mounted on the printed circuit.

In another embodiment, a receptacle connector assembly includes a printed circuit having opposite sides and an edge surface intersecting the sides, and a shell mounted on at least one of the sides of the printed circuit. The shell includes a receptacle for receiving a mating connector therein. A housing extends at least partially within the receptacle of the shell. An electrical contact is held by the housing. The electrical contact includes a mounting segment mounted on the printed circuit. The electrical contact includes a transition segment that extends outwardly from the mounting segment and projects beyond the edge surface of the printed circuit. The electrical contact includes a mating segment that extends outwardly from the transition segment and within the receptacle of the shell. The mating segment includes a mating surface that extends a length that is aligned with a plane that intersects the edge surface of the printed circuit.

DETAILED DESCRIPTION OF THE INVENTION

Figure 1:
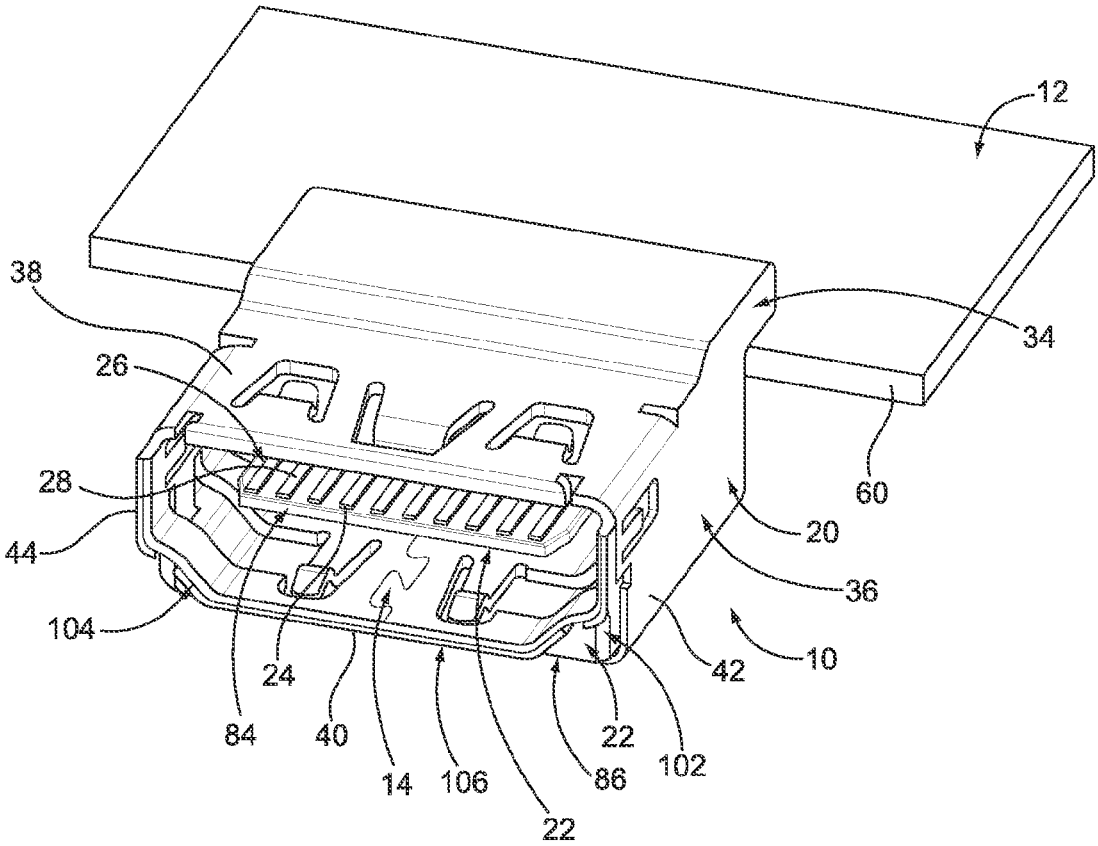
FIG. 1 is a perspective view of an exemplary embodiment of a receptacle connector mounted on an exemplary printed circuit.

FIG. 1 is a perspective view of an exemplary embodiment of a receptacle connector 10 mounted on an exemplary printed circuit 12. The receptacle connector 10 includes a receptacle 14 configured to receive a plug 16 (FIG. 2) of a mating connector 18 (FIG. 2) therein. The receptacle connector 10 may be any type of electrical connector that includes a receptacle that receives the plug of a mating connector therein. Optionally, the receptacle connector 10 is capable of and configured to communicate multimedia data. For example, the receptacle connector 10 can be used to communicate audio data, visual data, auxiliary data, and/or the like. Examples of multimedia data include audiovisual signals such as, but not limited to, digital television audiovisual signals between DVD players, set-top cable boxes, satellite boxes, other audiovisual sources, television sets, projectors, other video displays, and/or the like. The multimedia data communicated by the receptacle connector 10 can include multi-channel audio data, standard and/or high definition consumer electronic video data, control and/or status information between a source and receiver of the multimedia data, and/or the like. In some embodiments, the receptacle connector 10 is capable of communicating uncompressed digital streams comprising audio, video, and/or auxiliary data across a plurality of TMDS channels. One example of the receptacle connector 10 is a High Definition Multimedia Interface ("HDMI") receptacle connector.

The receptacle connector 10 includes a shell 20, a dielectric housing 22, and one or more electrical contacts 24 held by the housing 22. In the exemplary embodiment, the shell 20 is an electrically conductive shield. Alternatively, the shell 20 is at least partially dielectric. The shell 20 defines the receptacle 14. When the plug 16 of the mating connector 18 is received within the receptacle 14, mating contacts (not shown) of the mating connector 18 engage mating segments 26 of the electrical contacts 24 to electrically connect the receptacle connector 10 to the mating connector 18. As will be described below, the mating segments 26 of the electrical contacts 24 include mating surfaces 28 that extend a length that is aligned with a plane 30 (FIG. 6) that intersects an edge surface 60 of the printed circuit 12.

The shell 20 includes a mount 34 and a receptacle segment 36 extending outwardly from the mount 34. In the exemplary embodiment, the receptacle segment 36 includes opposite upper and lower walls 38 and 40, respectively, and opposite side walls 42 and 44. Interiors surfaces of the walls 38, 40, 42, and 44 define the receptacle 14 and provide the receptacle 14 with an exemplary generally rectangular cross-sectional shape. Although shown and described herein as having the generally rectangular shape, the receptacle segment 36 of the shell 20 may have any number of walls that define a receptacle 14 that includes any shape, such as, but not limited to, a generally circular shape, a generally triangular shape, an oval shape, a square shape, and/or the like.

Figure 2:
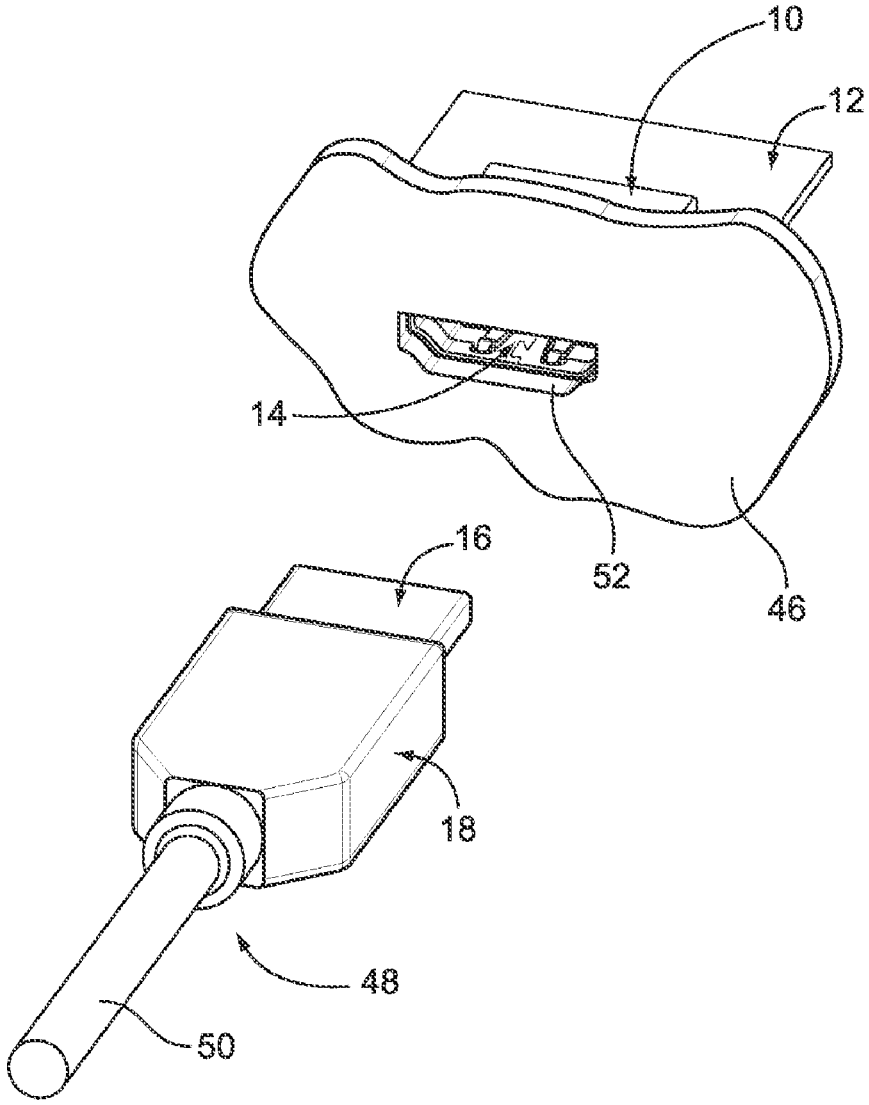
FIG. 2 is perspective view of the receptacle connector and printed circuit shown in FIG. 1 illustrating the receptacle connector mounted to an exemplary panel.

FIG. 2 is perspective view of the receptacle connector 10 and printed circuit 12 illustrating the receptacle connector 10 mounted to an exemplary panel 46. An exemplary mating connector 18 is also exemplary in FIG. 2. The mating connector 18 may be any type of electrical connector that includes a plug for reception within the receptacle 14 of the receptacle connector 10. In the exemplary embodiment, the mating connector 18 terminates, and is thereby electrically connected to, the end 48 of an electrical cable 50. In some embodiments, the mating connector 18 may be incorporated into the connection interface (not shown) of a docking station (not shown) or other electronic device. In addition or alternative to terminating the cable 50 and/or being incorporated into the connection interface, the mating connector 18 may be electrically connected to any electronic device for electrically connecting the electronic device to the receptacle connector 10 when the connectors 10 and 18 are mated together.

The receptacle connector 10 is mounted to the panel 46 such that the receptacle 14 is aligned with an opening 52 that extends through the panel 46. The opening 52 provides access to the receptacle 14 of the receptacle connector 10. The mating connector 18 is matable with the receptacle connector 10 through the opening 52 within the panel 46. Specifically, the plug 16 of the mating connector 18 can be inserted into the receptacle 14 of the receptacle connector 10 through the opening 52 within the panel 46.

The panel 46 may form a portion of a larger system of which the receptacle connector 10 and the printed circuit 12 are components thereof, such as, but not limited to, a computer, a machine, a server, and/or the like. The panel 46 may form any portion of the larger system, such as, but not limited to, a housing, rack, support structure, wall, and/or the like of the larger system. In some embodiments, the panel 46 forms a portion of and/or is a component of a connection interface of the larger system. Alternatively, the panel 46 may be a standalone panel that does not form a portion of a larger system.

Figure 3:
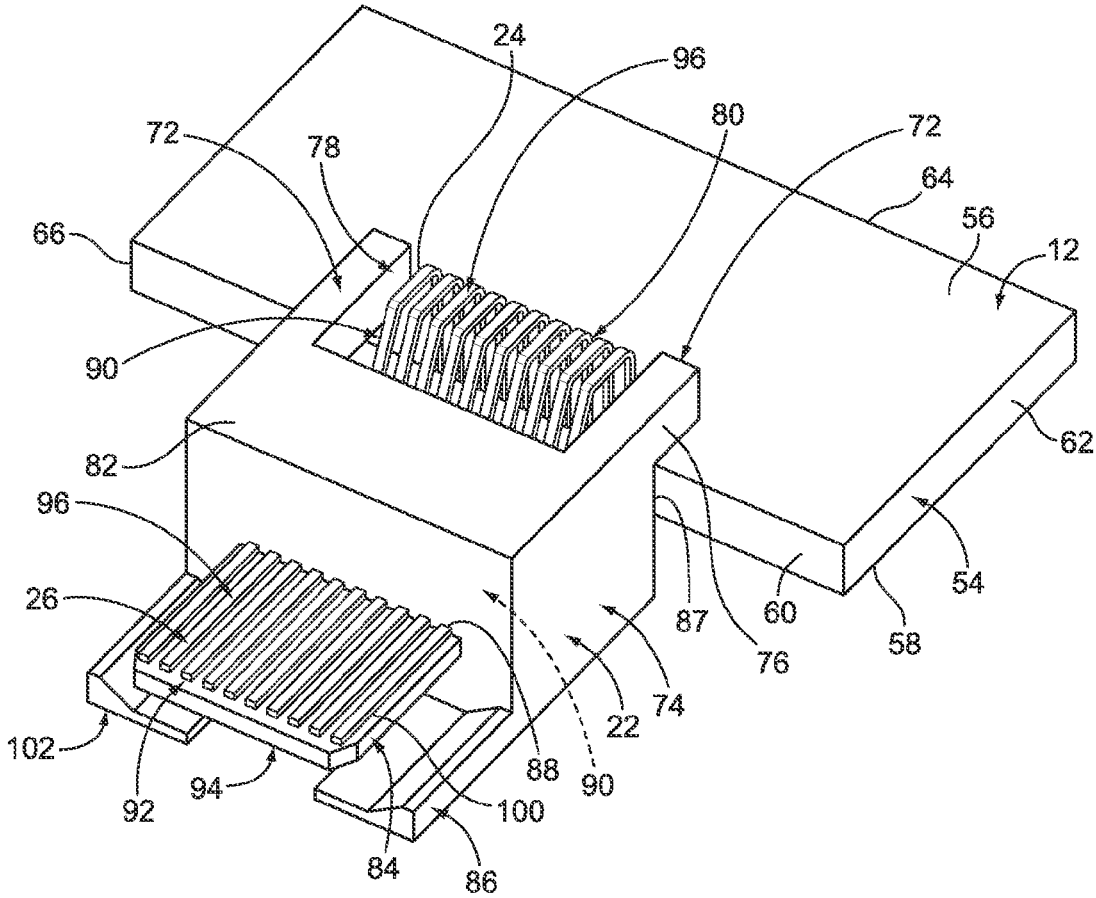
FIG. 3 is a perspective view of an exemplary embodiment of a housing of the receptacle connector shown in FIGS. 1 and 2 illustrating the housing mounted on the printed circuit.
Figure 6:
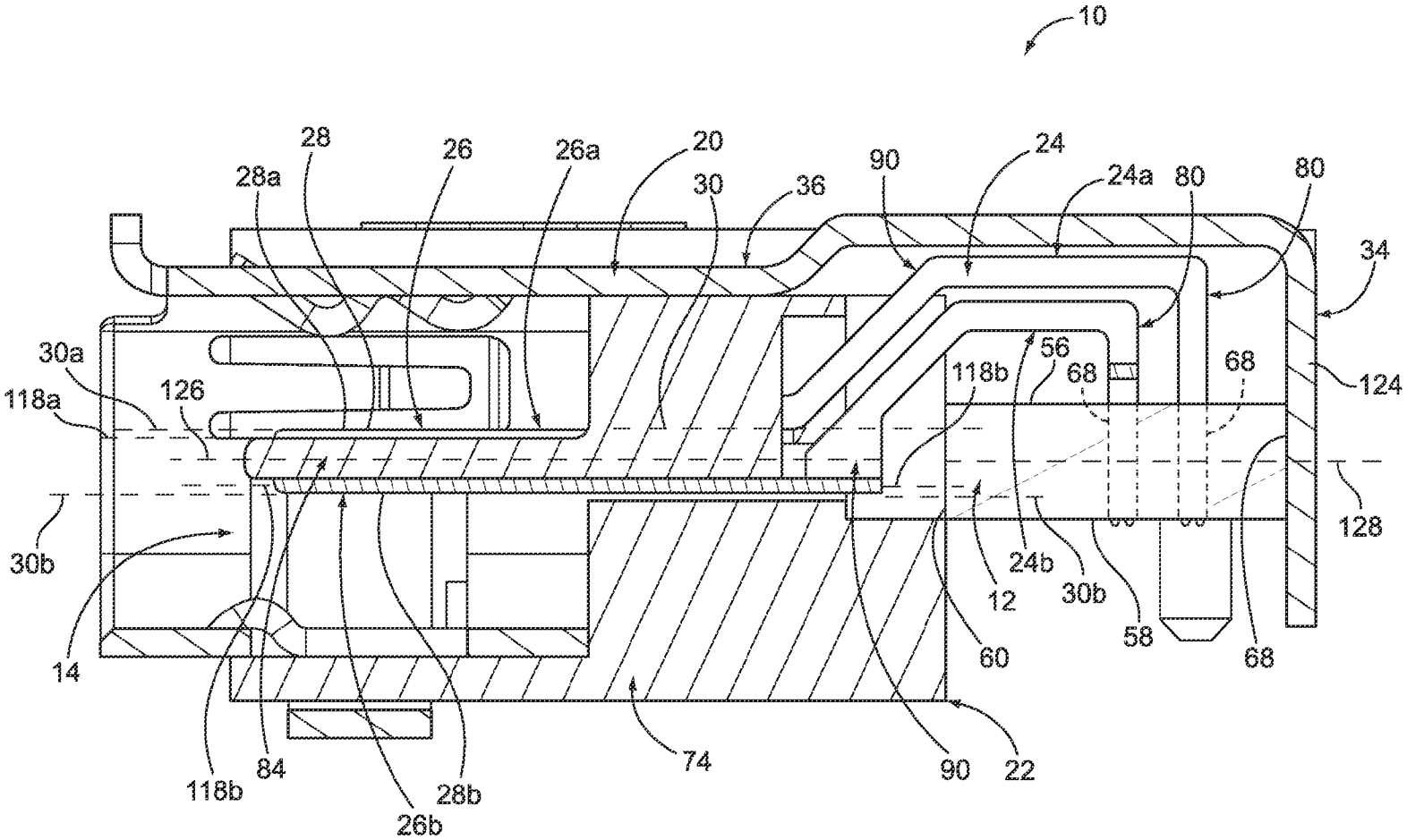
FIG. 6 is a cross sectional view of the receptacle connector shown in FIGS. 1 and 2.
Figure 7:
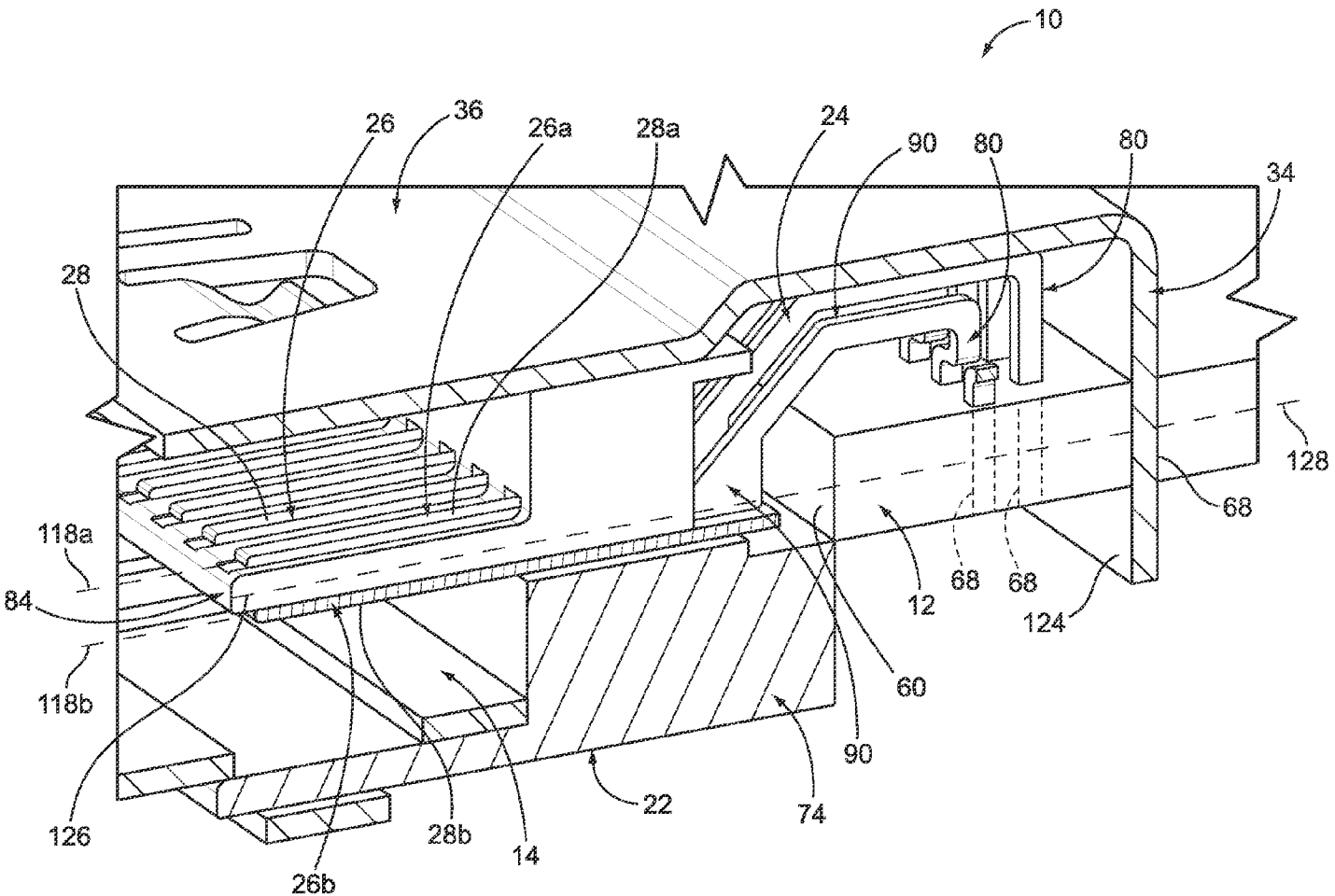
FIG. 7 is a perspective view of the receptacle connector cross section shown in FIG. 6.

FIG. 3 is a perspective view of an exemplary embodiment of the housing 22 illustrating the housing 22 mounted on the printed circuit 12. The electrical contacts 24 are shown held by the housing 22 in FIG. 3. As used herein, the term "printed circuit" is intended to mean any electric circuit in which the electrical conductors have been printed or otherwise deposited in predetermined patterns on an electrically insulating substrate. The printed circuit 12 includes a substrate 54 having a pair of opposite sides 56 and 58, and edge surfaces 60, 62, 64, and 66 that intersect the sides 56 and 58. The substrate 54 includes electrical circuit elements 68 (FIGS. 6 and 7). As will be described below, the shell 20 (FIGS. 1, 6, and 7) and the electrical contacts 24 of the receptacle connector 10 (FIGS. 1, 2, 6, and 7) electrically connect to the printed circuit 12 using at least some of the electrical circuit elements 68. The electrical circuit elements 68 may include, but are not limited to, electrical contacts (not shown), electrical traces (not shown), electrical vias, electrical ground planes (not shown), and/or the like. Each of the electrical circuit elements 68 may conduct electrical signals, electrical ground, and/or electrical power.

The substrate 54 may be a flexible substrate or a rigid substrate. The substrate 54 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 54 is a rigid substrate fabricated from epoxy-glass, such that the base printed circuit 12 is what is sometimes referred to as a "circuit board". In the exemplary embodiment, the substrate 54 includes only a single layer. Alternatively, the substrate 54 may include any number of layers greater than one layer. For example, the substrate 54 may include two exterior layers that each defines one of the sides 56 and 58, with one or more interior layers sandwiched between the exterior layers. Each interior layer of the substrate 54 may include electrical circuit elements 68 extending thereon and/or therethrough. Electrical circuit elements 68 of interior layers of the substrate 54 may electrically connect some or all of the electrical circuit elements 68 on the side 56 with one or more corresponding electrical circuit elements 68 on the side 58, and/or vice versa. In addition or alternatively, electrical circuit elements 68 of interior layers of the substrate 54 may electrically connect some or all of the electrical circuit elements 68 of the side 56 and/or the side 58 to any other location on or within the substrate 54 (such as, but not limited to, any location on any layer, including the same layer, of the substrate 54).

Any pattern of the electrical circuit elements 68 of the printed circuit 12 shown and/or described herein is meant as exemplary only. The electrical circuit elements 68 may be arranged in any other patterns than that which is shown and/or described herein. For example, the electrical circuit elements 68 may have any other spacing, or pitch, relative to each other than what is shown and/or described herein.

Although not shown, the substrate 54 may include one or more electrical components (not shown). Each of the electrical components may be active or passive. Examples of active electrical components include, but are not limited to, processors, amplifiers, and/or the like. Examples of passive electrical components include, but are not limited to, resistors, capacitors, inductors, diodes, and/or the like. Each of the electrical components may be electrically connected to one or more of the electrical circuit elements 68.

In the exemplary embodiment, the housing 22 includes a base 72 and a contact support segment 74 that extends outwardly from the base 72 and into the receptacle 14 (FIGS. 1, 2, 6, and 7) defined by the shell 20. The base 72 is mounted on the side 56 of the printed circuit 12. Specifically, the base 72 is defined by arms 76 that extend over and along, and engage, the side 56 of the printed circuit 12. A contact mounting area 78 is defined between the arms 76 for accommodating mounting segments 80 of the electrical contacts 24. The mounting segments 80 of the electrical contacts 24 extend within the contact mounting area 78 for engagement with the printed circuit 12. A portion of a transition segment 90 of each of the electrical contacts 24 also extends within the contact mounting area 78. Optionally, a contact organizer (not shown) is provided for holding the mounting segments 80 and/or the transition segments 90 of the electrical contacts 24 within the contact mounting area 78.

The arms 76 optionally include alignment posts (not shown) that are received within openings (not shown) within the substrate 54 of the printed circuit 12 to position the housing 22 relative to the substrate 54. Optionally, the arms 76 are directly mechanically connected to the substrate 54, such as, but not limited to, using an adhesive, the alignment posts, one or more latch members, a press (or interference) fit, a snap-fit, one or more fasteners, and/or the like. In addition or alternative to the direct mechanical connection between the arms 76 and the substrate 54, engagement between the shell 20 and the contact support segment 74 of the housing 22 may hold the arms 76 on the side 56 of the printed circuit 12. Although two are shown, the housing base 72 may include any number of the arms 76. Moreover, in some embodiments, the base 72 includes one or more arms that mount on the side 58 of the printed circuit 12. In some alternative embodiments, the housing 22 does not include the base 72. Specifically, alternatively the housing 22 is not mounted on either of the sides 56 or 58 of the printed circuit 12. In other words, the housing 22 alternatively does not include any portions that extend over and along either of the sides 56 or 58 of the printed circuit 12.

The contact support segment 74 includes a support block 82, a tongue 84 extending outwardly from the support block 82, and optional support extensions 86 extending outwardly from the support block 82. The support block 82 includes a shoulder 87 that optionally abuts the edge surface 60 of the printed circuit 12 when the housing base 72 is mounted on the printed circuit 12. The support block 82 includes a plurality of openings 88 that receive portions of the transition segments 90 of the electrical contacts 24 therein. Specifically, each of the transition segments 90 extends from the contact mounting area 78 into and through a corresponding one of the openings 88. When the housing 22 is held by the shell 20, the support block 82 extends within the receptacle 14 of the shell 20. Extension of the support block 82 within the receptacle 14 can be seen in FIGS. 6 and 7. The support block 82 is optionally mechanically connected to the shell 20 to facilitate holding the support block 82 within the receptacle 14 and/or to facilitate locating the housing 22 relative to the printed circuit 12. The support block 82 may be mechanically connected to the shell 20 using any structure, means, and/or the like, such as, but not limited to, using an adhesive, the alignment posts, one or more latch members, a press (or interference) fit, a snap-fit, one or more fasteners, and/or the like. The support block 82 may include any number of the openings 88 for each receiving any number of the transition segments 90.

The tongue 84 extends outwardly from the contact support block 82 in a direction generally away from the printed circuit 12. When the housing 22 is held by the shell 20, the tongue 84 extends within the receptacle 14 of the shell 20. Extension of the tongue 84 within the receptacle 14 can be seen in FIGS. 6 and 7. The tongue 84 includes an upper platform 92 and an opposite lower platform 94. The mating segments 26 of the electrical contacts 24 extend along the tongue 84. In the exemplary embodiment, the electrical contacts 24 include an upper set 96 and a lower set 98 (FIG. 6). In other words, the electrical contacts 24 are arranged in two rows. Alternatively, the receptacle connector 10 includes only a single row (of either the upper set 96 or the lower set 98) of electrically contacts 24. In another alternative embodiment, the receptacle connector 10 includes more than two rows of electrical contacts 24. The mating segments 26 of the upper set 96 of the electrical contacts 24 are arranged on the upper platform 92 of the tongue 84. Although not visible in FIG. 3, the mating segments 26 of the lower set 98 of the electrical contacts 24 are arranged on the lower platform 94 of the tongue 84. The mating segments 26 of the lower set 98 of the electrical contacts 24 can be seen extending on the lower platform 98 of the tongue 84 in FIGS. 6 and 7. Optionally, the upper and/or lower platforms 92 and 94, respectively, include one or more grooves 100 that hold at least a portion of one or more corresponding ones of the mating segments 26 of the electrical contacts 24 therein.

Similar to the tongue 84, the support extensions 86 extend outwardly from the contact support block 82 generally away from the printed circuit 12. Each support extension 86 extends outwardly from the contact support block 82 to a free end 102. The support extensions 86 are configured to engage the shell 20 to facilitate holding the housing 22 within the receptacle 14 of the shell 20 and/or to facilitate supporting the shell 20 when the plug 16 (FIG. 2) of the mating connector 18 (FIG. 2) is received within the receptacle 14. In the exemplary embodiment, and referring again to FIG. 1, the free ends 102 of the support extensions 86 extend under and engage corner portions 104 of the shell 20 to support a mating end 106 of the shell 20. The contact support segment 74 may include any number of the support extensions 86.

Figure 4:
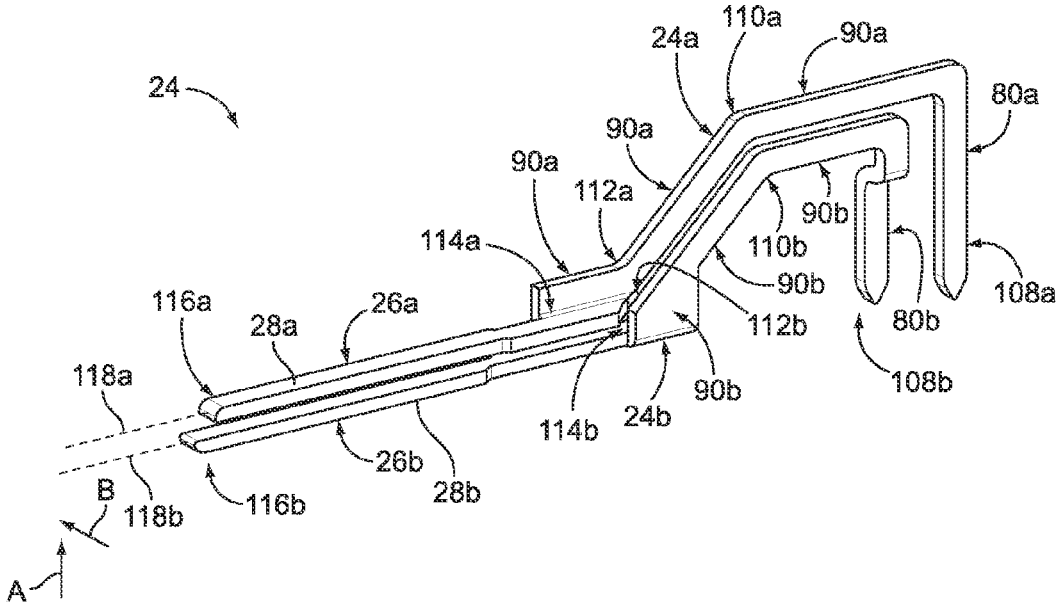
FIG. 4 is a perspective view of an exemplary embodiment of a pair of adjacent electrical contacts of the receptacle connector shown in FIGS. 1 and 2.

FIG. 4 is a perspective view of an exemplary embodiment of a pair of adjacent electrical contacts 24. Specifically, FIG. 4 illustrates an upper electrical contact 24*a* of the upper set 96 (FIGS. 3, 6, and 7) that is adjacent to a lower electrical contact 24*b* of the lower set 98 (FIGS. 6 and 7) of the electrical contacts 24. The upper and lower electrical contacts 24*a* and 24*b*, respectively, are arranged relative to each other in FIG. 4 as the electrical contacts 24*a* and 24*b* are arranged when held by the housing 22 (FIGS. 1, 3, 6, and 7) and mounted on the printed circuit 12 (FIGS. 1, 2, 3, 6, and 7). The upper electrical contact 24*a* includes a mounting segment 80*a*, a transition segment 90*a*, and a mating segment 26*a*. In the exemplary embodiment, the mounting segment 80*a* includes an end 108*a* of the upper electrical contact 24*a*. Alternatively, the mounting segment 80*a* may define a portion of the upper electrical contacts 24*a* that does not include the end 108*a*. The transition segment 90*a* extends outwardly from the mounting segment 80*a* and, in the exemplary embodiment, includes bends 110*a*, 112*a*, and 114*a*. The mating segment 26*a* extends outwardly from the transition segment 90*a* and includes a mating surface 28*a*. The mating segment 26*a* includes an end 116*a* of the upper electrical contact 24*a* that is opposite the end 108*a*, but alternatively the mating segment 26*a* may define a portion of the upper electrical contact 24*a* that does not include the end 116*a*. When the receptacle connector 10 (FIGS. 1, 2, 6, and 7) is mated with the mating connector 18 (FIG. 2), the mating surface 28*a* engages a corresponding mating contact of the mating connector 18 to electrically connect the connectors 10 and 18 together.

Similar to the upper electrical contact 24*a*, the lower electrical contact 24*b* includes a mounting segment 80*b*, a transition segment 90*b*, and a mating segment 26*b*. In the exemplary embodiment, the mounting segment 80*b* includes an end 108*b* of the lower electrical contact 24*b*. Alternatively, the mounting segment 80*b* may define a portion of the lower electrical contact 24*b* that does not include the end 108*b*. The transition segment 90*b* extends outwardly from the mounting segment 80*b* and includes bends 110*b*, 112*b*, and 114*b* in the exemplary embodiment. The mating segment 26*b* extends outwardly from the transition segment 90*b* and includes a mating surface 28*b*. The mating segment 26*b* includes an end 116*b* of the lower electrical contact 24*b* that is opposite the end 108*b*, but alternatively the mating segment 26*b* may define a portion of the lower electrical contact 24*b* that does not include the end 116*b*. When the receptacle connector 10 is mated with the mating connector 18, the mating surface 28*b* engages a corresponding mating contact of the mating connector 18 to electrically connect the connectors 10 and 18 together.

As can be seen in FIG. 4, when the electrical contacts 24*a* and 24*b* are held by the housing 22, the respective mating surfaces 28*a* and 28*b* face in generally opposite directions. Moreover, the mating segments 26*a* and 26*b* are staggered laterally and offset vertically from each other. Specifically, the mating segments 26*a* and 26*b* extend lengths along respective central longitudinal axes 118*a* and 118*b*. The axes 118*a* and 118*b* are offset from each other vertically in the direction of the arrow A, and are staggered laterally relative to each other in the direction of the arrow B. Accordingly, when held by the housing 22, the mating segment 26 of each electrical contact 24 of the upper set 96 is staggered laterally and offset vertically from the mating segment 26 of the electrical contact 24 of the lower set 98 that is adjacent thereto. Optionally, portions of the transitions segments 90*a* and 90*b* and portions of the mounting segments 80*a* and 80*b* extend approximately coplanar with each other when the electrical contacts 24*a* and 24*b* are held by the housing 22.

Figure 5:
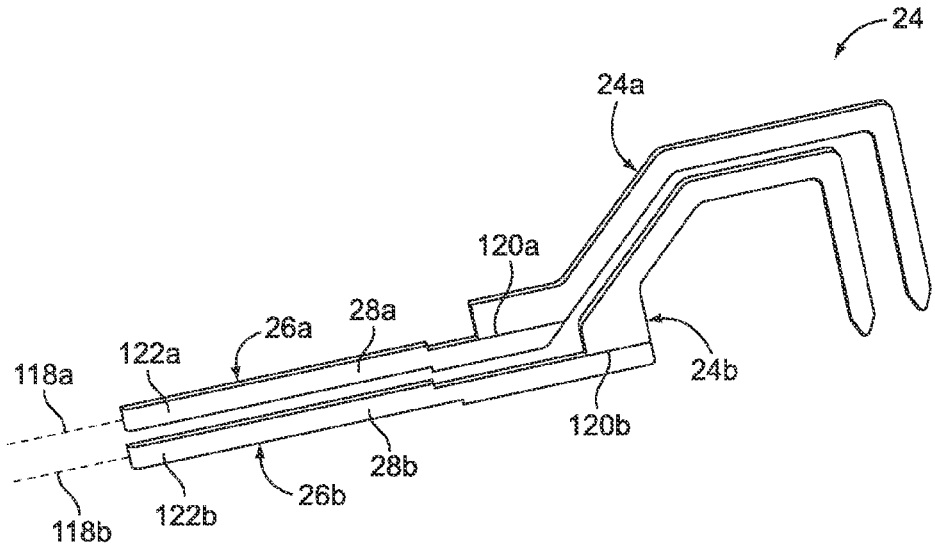
FIG. 5 is a perspective view of an exemplary embodiment of the electrical contacts shown in FIG. 4 in a partially fabricated state.

FIG. 5 is a perspective view of an exemplary embodiment of the upper and lower electrical contacts 24*a* and 24*b*, respectively, in a partially fabricated state. The electrical contacts 24 are configured such that adjacent electrical contacts 24 of the upper and lower sets 96 and 98, respectively, can be optionally formed (such as, but not limited to, cut, stamped, and/or like) from the same sheet of material (not shown). In some embodiments, all of the electrical contacts 24 of the receptacle connector 10 (FIGS. 1, 2, 6, and 7) that extend on the tongue 84 (FIGS. 1-3, 6, and 7) are formed from the same sheet of material. FIG. 5 illustrates the upper and lower electrical contacts 24*a* and 24*b*, respectively, after having been formed from the same sheet of material. As can be seen in FIG. 5, after having been formed from the same sheet of material, the upper and lower contacts 24*a* and 24*b*, respectively, extend approximately parallel to each other. More particularly, the central longitudinal axes 118*a* and 118*b* of the upper and lower electrical contacts 24*a* and 24*b*, respectively, lie approximately within a plane; and the mating surfaces 28*a* and 28*b* of the upper and lower electrical contacts 24*a* and 24*b*, respectively, lie approximately within the same plane. To complete fabrication of the upper and lower electrical contacts 24*a* and 24*b*, respectively, the contacts 24*a* and 24*b* are bent about the respective lines 120*a* and 120*b* to form the respective bends 114*a* and 114*b* (FIG. 4) and thereby stagger laterally the mating segments 26*a* and 26*b* relative to each other causing them to face in opposite directions. The mating surfaces 28*a* and 28*b* are optionally covered with one or more precious metals and/or other materials 122*a* and 122*b*, respectively. It may be advantageous to cover the mating surfaces 28*a* and 28*b* with the precious metal(s) and/or other materials before bending the contacts 24*a* and 24*b* about the respective lines 120*a* and 120*b* as the mating surfaces 28*a* and 28*b* are coplanar before the bending. For example, a plating printed wheel (not shown) can be used in a more efficient manner when the mating surfaces 28*a* and 28*b* are coplanar, which may reduce an amount of the precious metal(s) and/or other materials used to cover the mating surfaces 28*a* and 28*b*.

FIG. 6 is a cross sectional view of the receptacle connector 10. FIG. 7 is a perspective view of the receptacle connector cross section shown in FIG. 6. Referring now to FIGS. 6 and 7, the mounting segments 80 of the electrical contacts 24 are mounted on and electrically connected to the printed circuit 12. Specifically, the mounting segments 80 of the electrical contacts 24 are engaged with and electrically connected to corresponding electrical circuit elements 68 of the printed circuit 12. In the exemplary embodiment, the electrical circuit elements 68 engaged with the mounting segments 80 of the electrical contacts 24 are electrical vias and the mounting segments 80 are posts that are received within the electrical vias. Alternatively, one or more of the mounting segments 80 of the electrical contacts 24 is engaged with and electrically connected to the corresponding electrical circuit element(s) 68 using a surface mount configuration (such as, but not limited to, using a surface mount pad (not shown) and/or the like).

The mount 34 of the shell 20 is mounted on and electrically connected to the printed circuit 12. The mount 34 is engaged with and electrically connected to a corresponding electrical circuit element 68 of the printed circuit 12. In the exemplary embodiment, the electrical circuit element 68 engaged with the mount 34 of the shell 20 is an electrical via and the mount 34 includes a post 124 that is received within the electrical vias. But, the mount 34 may additionally or alternatively engage and electrically connect to the corresponding electrical circuit element(s) 68 using a surface mount configuration (such as, but not limited to, using a surface mount pad (not shown) and/or the like).

When the shell 20 is mounted on the printed circuit 12, the receptacle segment 36 extends outwardly from the mount 34 and over the edge surface 60 of the printed circuit 12. Similarly, the contact support segment 74 extends outwardly from the base 72 (FIG. 3) of the housing 22 over the edge surface 60 of the printed circuit 12. The tongue 84 of the housing 22 is offset from the base 72 such that, in the exemplary embodiment, the tongue 84 extends a length along a central longitudinal axis 126 that lies within a central plane 128 along which the printed circuit 12 extends. In other words, in the exemplary embodiment, the central longitudinal axis 126 of the tongue 84 is aligned with the central plane 128 of the printed circuit 12. Alternatively, the central longitudinal axis 126 may be offset from the central plane 128.

When the electrical contacts 24 are mounted on the printed circuit 12 and held by the housing 22, the transition segments 90 of the electrical contacts 24 extend outwardly from the mounting segments 80 and project beyond the edge surface 60 of the printed circuit 12. Each of the mating segments 26 of the electrical contacts 24 extends outwardly from the corresponding transition segment 90 such that the mating surface 28 thereof extends a length that is aligned with a plane 30 (not shown in FIG. 7) that intersects the edge surface 60 of the printed circuit 12. For example, the mating surface 28*a* of each upper electrical contact 24*a* extends a length that is aligned with a plane 30*a* that intersects the edge surface 60, while the mating surface 28*b* of each lower electrical contact 24*b* extends a length that is aligned with a plane 30*b* that intersects the edge surface 60. The central longitudinal axes 118*a* and 1186 of the mating segments 26*a* and 26*b* of each upper and lower electrical contact 24*a* and 24*b*, respectively, intersects the edge surface 60 of the printed circuit 12. In the exemplary embodiment, the planes 30*a* and 30*b* and the axes 118*a*, 118*b*, and 126 each extend approximately parallel to the central plane 128 of the printed circuit 12 and to each of the sides 56 and 58 of the printed circuit 12. Alternatively, the plane 30*a*, the plane 30*b*, the axis 118*a*, the axis 118*b*, and/or the axis 126 extends non-parallel relative to the central plane 128, the side 56, and/or the side 58.

The embodiments described and/or illustrated herein may provide a receptacle connector that is more efficiently mounted on printed circuit that at least some known receptacle connectors. The embodiments described and/or illustrated herein may provide a receptacle connector and printed circuit having a reduced overall size relative to at least some known receptacle connectors and printed circuits. The embodiments described and/or illustrated herein may provide an interface of an electronic device having more connectors than at least some known interfaces. The embodiments described and/or illustrated herein may provide an interface of an electronic device that has one or more connectors aligned in a line and/or is more aesthetically pleasing than at least some known interfaces. The embodiments described and/or illustrated herein may provide electrical contacts that are less difficult and/or less expensive to fabricate than at least some known electrical contacts. The embodiments described and/or illustrated herein may provide electrical contacts that can be fabricated from the same sheet of material. The embodiments described and/or illustrated herein may provide electrical contacts that can be assembled at the same time. The embodiments described and/or illustrated herein may provide electrical contacts with mating surfaces that can be more easily covered, and/or cost less to cover, with one or more precious metals and/or other materials than at least some known electrical contacts.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector for mounting on a printed circuit having opposite sides and an edge surface intersecting the sides, the printed circuit extending along a central plane, said connector comprising:

a shell having a mount configured to be mounted on at least one of the sides of the printed circuit, the shell comprising a receptacle for receiving a mating connector therein;

a housing extending at least partially within the receptacle of the shell, the housing comprising a tongue that extends within the receptacle of the shell, the tongue comprising a platform, the tongue extending a length along a central longitudinal axis that is aligned with the central plane of the printed circuit when the receptacle connector is mounted on the printed circuit; and an electrical contact held by the housing, the electrical contact comprising a mounting segment configured to be mounted on the printed circuit, the electrical contact comprising a transition segment that extends outwardly from the mounting segment and projects beyond the edge surface of the printed circuit when the electrical contact is mounted on the printed circuit, the electrical contact comprising a mating segment that extends outwardly from the transition segment and within the receptacle of the shell, the mating segment of the electrical contact being arranged on the platform of the tongue, the mating segment comprising a mating surface that extends a length that is aligned with a plane that intersects the edge surface of the printed circuit when the electrical contact is mounted on the printed circuit.

2. The connector according to claim 1, wherein the housing comprises a base configured to be mounted on at least one of the sides of the printed circuit, the housing comprising a contact support segment that extends outwardly from the base and over the edge surface of the printed circuit when the base is mounted on the printed circuit.

3. The connector according to claim 1, wherein the housing comprises a base configured to be mounted on at least one of the sides of the printed circuit, the housing comprising a contact support segment that extends outwardly from the base and over the edge surface of the printed circuit when the base is mounted on the printed circuit, the contact support segment comprising the tongue, the tongue being offset from the base to extend the length along the central longitudinal axis that is aligned with the central plane of the printed circuit when the base is mounted on the printed circuit.

4. The connector according to claim 1, wherein the platform of the tongue is a lower platform, the tongue comprising an upper platform that is opposite the lower platform, the electrical contact comprising electrical contacts, the mating segments of an upper set of the electrical contacts being arranged on the upper platform, the mating segments of a lower set of the electrical contacts being arranged on the lower platform.

5. The connector according to claim 1, wherein the shell comprises a receptacle segment extending outwardly from the mount and over the edge surface of the printed circuit when the mount is mounted on the printed circuit, the receptacle segment defining the receptacle.

6. The connector according to claim 1, wherein the housing comprises a base configured to be mounted on at least one of the sides of the printed circuit, the housing comprising a contact support segment that extends outwardly from the base, the contact support segment comprising a shoulder that abuts the edge surface of the printed circuit when the base is mounted on the printed circuit.

7. The connector according to claim 1, wherein the mating segment of the electrical contact extends a length along a central longitudinal axis that intersects the edge surface of the printed circuit when the electrical contact is mounted on the printed circuit.

8. The connector according to claim 1, wherein the plane extends substantially parallel to at least one of the sides of the printed circuit.

9. The connector according to claim 1, wherein the mounting segment of the electrical contact comprises at least one of a post configured to be received within a via of the printed circuit; and a surface mount pad configured to be mounted on one of the sides of the printed circuit.

10. The connector according to claim 1, wherein the electrical contact is a first electrical contact and the edge surface of the printed circuit extends a height from one of the sides of the printed circuit to the other side, the receptacle connector further comprising a second electrical contact having a mating segment that is offset from the mating segment of the first electrical contact along the height of the printed circuit, the mating segment of the second electrical contact comprising a mating surface that extends a length that is aligned with a plane that intersects the edge surface of the printed circuit.

11. The connector according to claim 1, wherein the electrical contact is a first electrical contact and the platform of the tongue is an upper platform, the tongue having a lower that is opposite the upper platform, the mating segment of the first electrical contact being arranged on the upper platform, the receptacle connector further comprising a second electrical contact having a mating segment that is arranged on the lower platform, wherein the mating segment of the second electrical contact comprises a mating surface that extends a length that is aligned with a plane that intersects the edge surface of the printed circuit.

12. The connector according to claim 1, wherein the mating segment comprises an undeflected state, the length of the mating surface being aligned with the plane that intersects the edge surface of the printed circuit when the mating segment is in the undeflected state.

13. A receptacle connector assembly comprising:

a printed circuit having opposite sides and an edge surface intersecting the sides, the edge surface of the printed circuit extending a height from one of the sides of the printed circuit to the other side;

a shell mounted on at least one of the sides of the printed circuit, the shell comprising a receptacle for receiving a mating connector therein;

a housing extending at least partially within the receptacle of the shell; and first and second electrical contacts held by the housing, the first electrical contact comprising a mounting segment mounted on the printed circuit, the first electrical contact comprising a transition segment that extends outwardly from the mounting segment and projects beyond the edge surface of the printed circuit, the first electrical contact comprising a mating segment that extends outwardly from the transition segment and within the receptacle of the shell, the mating segment of the first electrical contact comprising a mating surface that extends a length that is aligned with a plane that intersects the edge surface of the printed circuit, the second electrical contact having a mating segment that is offset from the mating segment of the first electrical contact along the height of the printed circuit, the mating segment of the second electrical contact comprising a mating surface that extends a length that is aligned with a plane that intersects the edge surface of the printed circuit.

14. The assembly according to claim 13, wherein the housing comprises a base mounted on at least one of the sides of the printed circuit, the housing comprising a contact support segment that extends outwardly from the base and over the edge surface of the printed circuit.

15. The assembly according to claim 13, wherein the printed circuit extends along a central plane, the housing comprising a base mounted on at least one of the sides of the printed circuit, the housing comprising a contact support segment that extends outwardly from the base and over the edge surface of the printed circuit, the contact support segment comprising a tongue that is offset from the base to extend a length along a central longitudinal axis that is aligned with the central plane of the printed circuit.

16. The assembly according to claim 13, wherein the housing comprises a tongue extending within the receptacle of the shell, the tongue comprising opposite upper and lower platforms, the mating segment of the first electrical contact being arranged on the upper platform, the mating segment of the second electrical contact being arranged on the lower platform.

17. The assembly according to claim 13, wherein the shell comprises a receptacle segment extending outwardly from the mount and over the edge surface of the printed circuit, the receptacle segment defining the receptacle.

18. The assembly according to claim 13, wherein the housing comprises a base mounted on at least one of the sides of the printed circuit, the housing comprising a contact support segment that extends outwardly from the base, the contact support segment comprising a shoulder that abuts the edge surface of the printed circuit.

19. The assembly according to claim 13, wherein the mating segment of the first electrical contact extends a length along a central longitudinal axis that intersects the edge surface of the printed circuit.

20. The assembly according to claim 13, wherein the plane extends substantially parallel to at least one of the sides of the printed circuit.

21. The assembly according to claim 13, wherein the mounting segment of the first electrical contact comprises at least one of:

a post received within a via of the printed circuit; and a surface mount pad mounted on one of the sides of the printed circuit.

* * * * *